United States Patent [19]

Bauer

[11] 4,055,828

[45] Oct. 25, 1977

[54] CONDITION RESPONSIVE CONTROL DEVICE

[75] Inventor: Werner R. Bauer, Radnor, Pa.

[73] Assignee: Robertshaw Controls Company, Richmond, Va.

[21] Appl. No.: 596,104

[22] Filed: July 16, 1975

[51] Int. Cl.[2] ..... H01H 37/76

[52] U.S. Cl. ..... 337/308; 337/309

[58] Field of Search ..... 73/368.1; 307/118, 144; 219/513; 236/4, 18, 32, 42, 56, 64, 86, 99 G; 337/306, 308–313, 315, 320–326, 327, 40, 336; 200/83 C, 83 J

[56] References Cited

U.S. PATENT DOCUMENTS

| | | | |
|---|---|---|---|
| 2,216,589 | 10/1940 | Grooms | 337/306 X |
| 2,889,432 | 6/1959 | Miller | 337/311 X |

FOREIGN PATENT DOCUMENTS

| | | | |
|---|---|---|---|
| 985,939 | 3/1965 | United Kingdom | 337/309 |

*Primary Examiner*—Harold Broome
*Attorney, Agent, or Firm*—Candor, Candor & Tassone

[57] ABSTRACT

A control device having a housing carrying a condition responsive unit and an electrical switch to be operated by the condition responsive unit, the housing having a pivotally mounted lever to translate motion from a movable wall of the condition responsive unit to the switch and having a range spring to oppose movement of the movable wall in one direction thereof. An actuator is dispoed between the movable wall of the condition responsive unit and the range spring and is engagable therewith, the actuator being unitary between the movable wall and the range spring and carrying a pin that is operatively associated with the lever to cause pivoting movement of the lever as the actuator is moved relative to the housing. A push rod unit translates motion between the lever and the switch, the push rod unit having a pivot bearing arrangement therein to compensate for different pivot movements of the lever and the switch. A spring is carried by the housing and is operatively associated with the lever to lower the differential of the control without imposing force on the pivot point of the lever.

14 Claims, 4 Drawing Figures

CONDITION RESPONSIVE CONTROL DEVICE

This invention relates to an improved condition responsive control device or the like.

It is well known that control devices have been provided wherein each has a housing carrying a condition responsive unit and an electrical switch to be operated by the condition responsive unit, the housing having a pivotally mounted lever to translate motion from a movable wall of the condition responsive unit to the switch and having a range spring to oppose movement of the movable wall in one direction thereof. For example, see the U.S. Pat. No 3,447,116 to Good.

It is a feature of this invention to provide an improved control device of the above type.

In particular, one feature of this invention is to provide an improved actuator between the condition responsive unit and the range spring for operating on the lever.

For example, one embodiment of this invention provides such a control device wherein a unitary actuator is provided between the movable wall of the condition responsive unit and the range spring and carries a pin that is operatively associated with the lever to cause pivoting movement of the lever as the actuator is moved relative to the housing.

Another feature of this invention is to provide such a control device with an improved push rod unit between the lever and the switch for operating the switch.

For example, one embodiment of this invention provides such a control device with a push rod unit between the lever and the switch to translate motion therebetween, the push rod unit having pivot bearing means therein to compensate for different pivot movements of the lever and the switch.

Another feature of this invention is to provide an improved means for lowering the differential of the control without adversely effecting the same.

For example, one embodiment of this invention provides such a control device with biasing means being carried by the housing and being operatively associated with the lever to lower the differential of the control without imposing force on the pivot point of the lever thereof.

Accordingly, it is an object of this invention to provide a condition responsive control device having one or more of the novel features set forth above or hereinafter shown or described.

Other objects, uses and advantages of this invention are apparent from a reading of this description which proceeds with reference to the accompanying drawings forming a part thereof and wherein.

Figure 1:
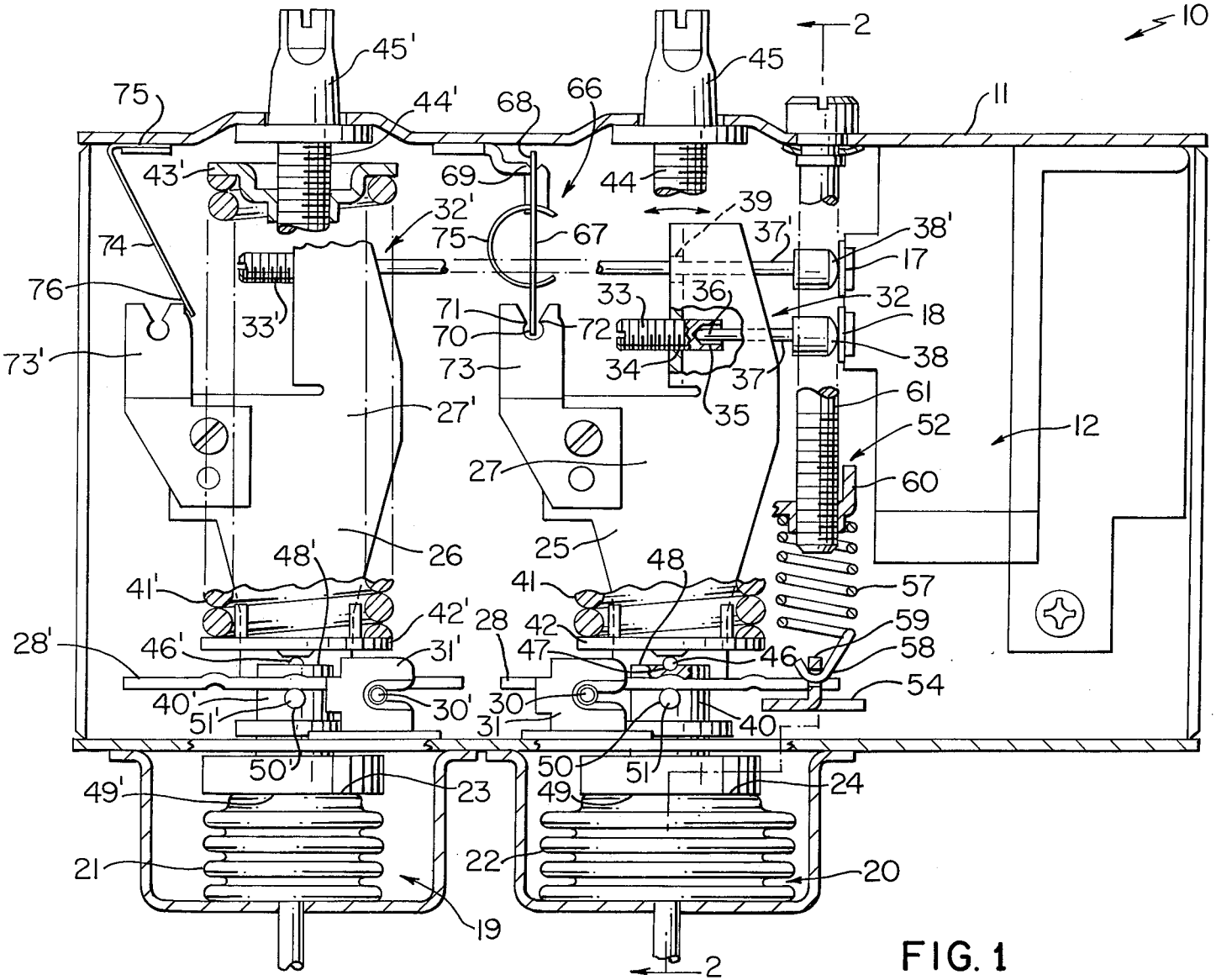
FIG. 1 is a cross-sectional view with certain parts broken away and illustrating the improved control device of this invention.

While the various features of this invention are hereinafter described and illustrated as being particularly adapted to provide a dual control, it is to be understood that the various features of this invention can be utilized singly or in any combination thereof for providing other types of control devices as desired.

Therefore, this invention is not to be limited to only the embodiments illustrated in the drawings, because the drawings are merely utilized to illustrate one of the wide variety of uses of this invention.

Figure 2:
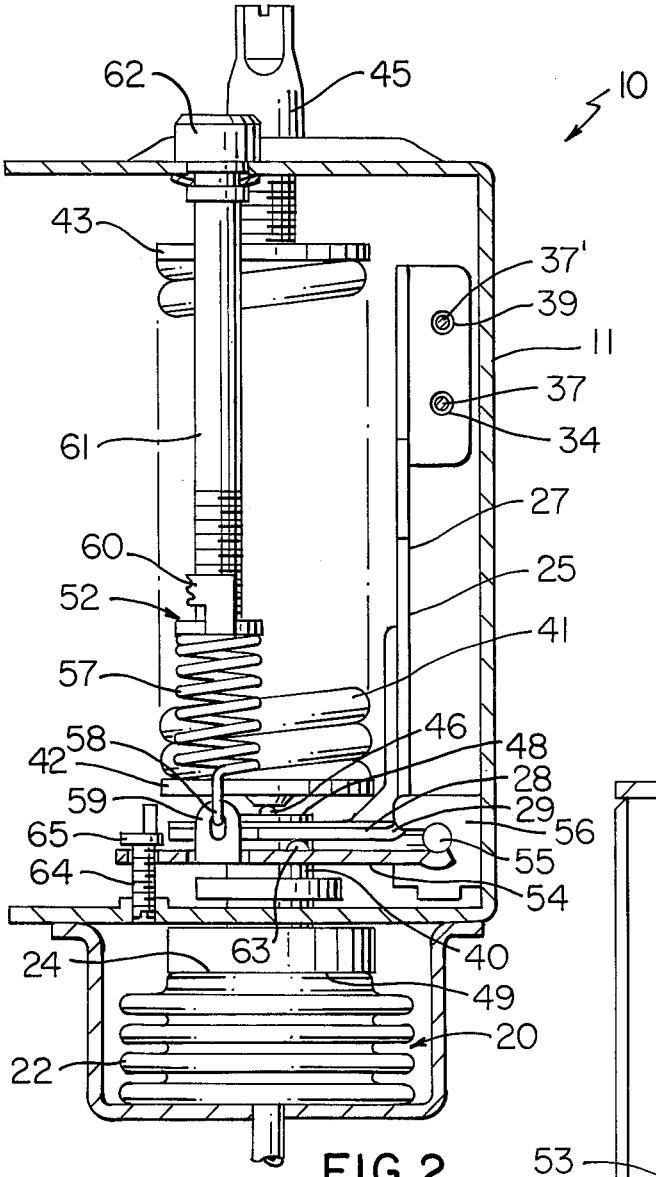
FIG. 2 is a cross-sectional view taken on line 2—2 of FIG. 1.
Figure 4:
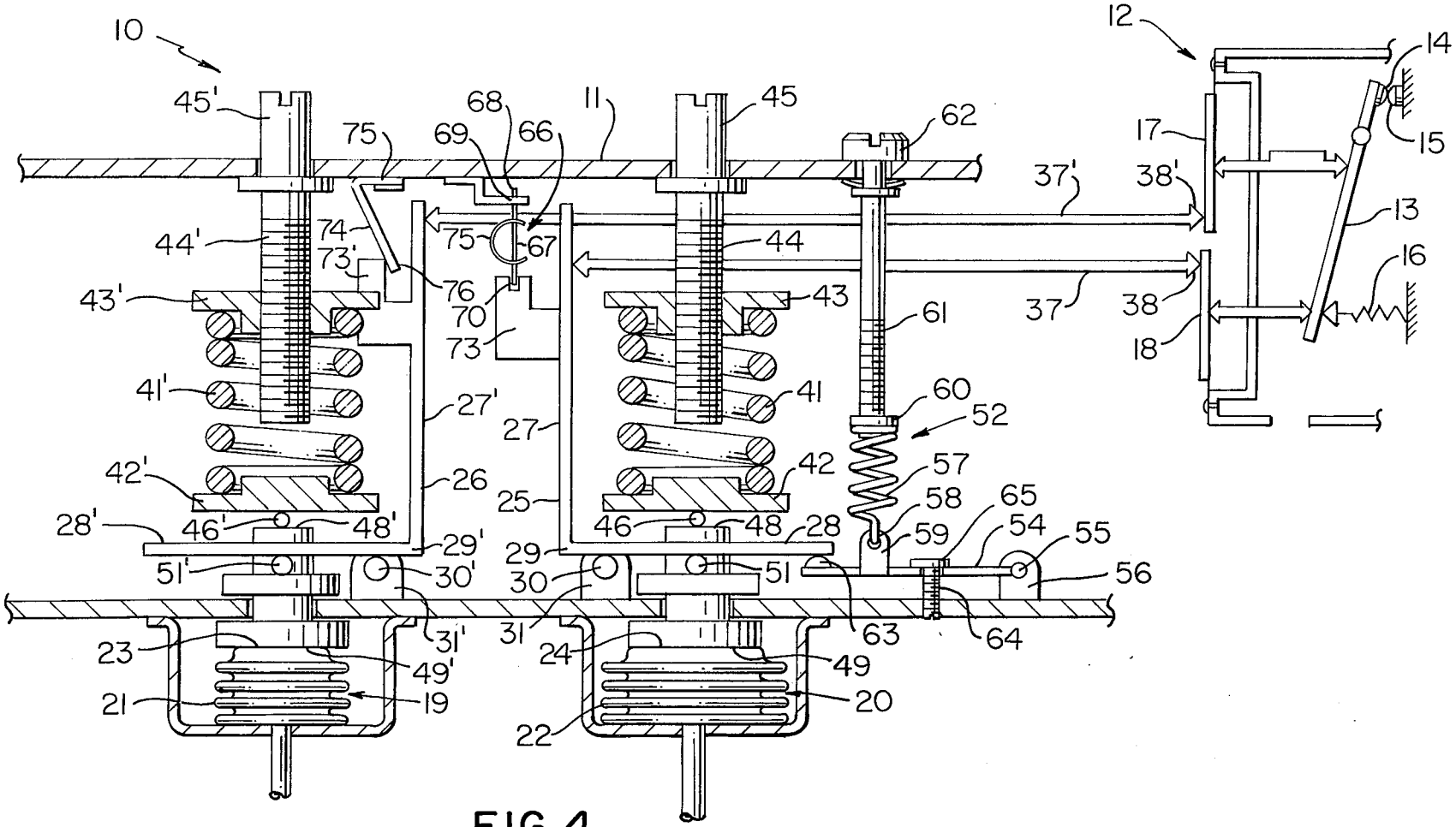
FIG. 4 is a schematic view similar to FIG. 1 and is provided to fully illustrate the operating characteristics of the control device of FIG. 1.

Referring now to FIGS. 1, 2 and 4, the improved control device of this invention is generally indicated by the reference numeral 10 and comprises a housing means 11 carrying an electrical switch 12 for controlling any suitable structure, the electrical switch 12 being schematically illustrated in FIG. 4 and including a movable switch blade 13 carrying a contact 14 that cooperates with a fixed contact 15 when the switch blade 13 has its movable contact 14 normally urged into contact with the fixed contact 15 by a suitable compression spring 16 acting on the switch blade 13.

However, a pair of plungers or levers 17 and 18 are provided for the electrical switch 12 and each lever 17 and 18 when moved to the left in FIGS. 1 and 4, in a manner hereinafter described, will operate on the switch blade 13 in opposition to the force of the compression spring 16 to move the movable contact 14 out of contact with the fixed contact 15. However, when that particular lever 17 and 18 is moved back to the left by the force of the compression spring 16 in a manner hereinafter described, the movable contact 14 is again placed into contact with the fixed contact 15.

While the electrical switch 12 can be of any suitable structure to function in the manner previously set forth and hereinafter described, a typical electrical switch 12 that can be utilized for the control device 10 of this invention is disclosed and claimed in the copending patent application Ser. No. 557,462, filed Mar. 12, 1975.

A pair of condition responsive units 19 and 20 are respectively carried by the housing means 11 and comprise bellows constructions 21 and 22 respectively having movable walls 23 and 24 for moving upwardly in FIGS. 1 and 2 as the pressure within the bellows constructions 19 and 22 increases and for moving downwardly when the pressure in the bellows constructions 21 and 22 decreases.

A pair of like levers 25 and 26 are pivotally carried by the housing means 11 in a manner hereinafter described with the levers 25 and 26 each being respectively operatively associated with the condition responsive units 20 and 19.

Since the lever 26 and its associated parts are identical to the lever 25 and its associated parts, except as hereinafter described, only the lever 25 will be hereinafter described in detail with like reference numerals being placed on the drawings for the lever 26 and its associated parts and being followed by a prime mark so that the description applying to the lever 25 can be applied to the lever 26 as desired.

As illustrated in FIGS. 1 and 2, the lever 25 is substantially L-shaped and is defined by a pair of arms 27 and 28 disposed at right angles relative to each other by an elbow 29 whereby the arm 28 is substantially horizontally disposed as illustrated in the drawings while the arm 27 is substantially vertically disposed.

The arm 28 of the lever 25 is pivotally mounted to the housing means 11 transverse to the elbow 29 by a pivot pin 30 being secured to the arm 28 and being slidably received in suitable bearing means 31 of the housing means 11 so that the lever 25 is adapted to pivot in a clockwise and counterclockwise direction in FIGS. 1 and 4 about the pivot pin or point 30.

A push rod arrangement or unit for the lever 25 is generally indicated by the reference numeral 32 and, as illustrated in FIG. 1, includes an externally threaded socket member 33 threadedly disposed in a threaded bore 34 in the arm 27 of the lever 25 and having a socket portion 35 thereof receiving a rounded end 36 of a rod 37 that has an enlarged opposed rounded end 38 bearing against the lever or plunger 18 of the electrical switch 12.

In this manner, the opposed rounded ends 36 and 38 of the rod 37 provide pivot bearing means for the push rod arrangement 32 so that the different arcuate or pivoting movements of the lever 25 and the lever 18 of the switch 12 will be compensated for by the rounded ends 36 and 38 of the rod 37 to substantially reduce friction and binding action therebetween.

The lever 25 also has another threaded opening 39 in the arm 27 above the threaded opening 34 thereof and through which the push rod 37' of the push rod arrangement 32' for the lever 26 passes so as to have its enlarged end 38' bear against the lever 17 of the switch 12. In this manner, the adjusting member 33' of the push rod arrangement 32' for the lever 26 is rotatably mounted in the upper threaded opening in the arm 27' thereof rather that in the opening thereof as is apparent from FIG. 1.

A unitary actuator 40 for the lever 25 is disposed between the movable wall 24 of the condition responsive unit 20 and a range spring 41 that is disposed between a pair of spring retainers 42 and 43, the spring retainer 43 being threadedly disposed on a threaded portion 44 of a range spring adjustor 45 whereby the force of the range spring 41 acting downwardly on the actuator 40, and, thus, on the movable wall 24 of the condition responsive device 20 can be adjusted in a manner well known in the art.

However, the lower spring retainer 42 carries a ball 46 which is received in a socket 47 in the upper end 48 of the unitary actuator 40 while the lower end 49 of the actuator 40 bears against the movable wall 24 of the condition responsive device 20 as illustrated. In this manner, the ball 46 on the spring retainer 42 compensates for any misalignment between the range spring 41 and the condition responsive unit 20 as the ball 46 acts as a universal joint therebetween.

The actuator 40 has a side opening 50 passing therethrough and in which is secured a closely fitting cylindrical pin 51 that can project from opposed sides of the opening 50 and be secured against the arm 28 of the lever 27 so as to translate movement of the actuator 40 in an up and down direction to the arm 28 of the lever 25.

It has been found that in prior control devices, the range spring 41 imposed one force on the lever 25 and the movable wall 24 of the condition responsive device 20 provided an opposing force on the lever 25 as the actuator disposed therebetween was normally split so as to act on opposed sides of the arm of the lever 25 whereby an adverse hysteresis in the movement of the lever was produced through the resulting friction of the split actuator acting on opposed sides of the lever or a pin being carried thereby as the case may be.

Therefore, by making the actuator 40 unitary between the opposed ends 48 and 49 thereof, the forces respectively provided on the ends 48 and 49 of the actuator 40 by the range spring 41 and the condition responsive device 20 will have no reaction on the pin 51 whereby such arrangement will eliminate any force being transmitted to the pivot point 30 and bearings 31 of the control device 10 of this invention.

If it is desired to have an adjustable differential for the lever 25 of the control device 10, an adjustable means that is generally indicated by the reference numeral 52 can be provided and is best illustrated in FIG. 1 of the drawings. If an adjustable differential is to be provided for the lever 26, the same can be provided in the manner illustrated in FIG. 3 and is generally indicated by the reference numeral 53. However, since the adjustable means 52 and 53 are similar, only the adjustable means 52 of the lever 25 will be described and like reference numerals will be utilized in the drawings for the adjustment means 53 followed by prime mark.

As illustrated in FIGS. 1 and 2, a lever 53 is pivotally mounted to the housing means 11 by a pivot pin 55 carried by the lever 54 and disposed in suitable bearing means 56. A tension spring 57 has one end 58 interconnected to an upstanding tang 59 on the lever 54 and the other end carried by a threaded retainer 60 threadedly disposed on a threaded shaft 61 of an adjusting member 62 rotatably carried by the housing means 11.

In this manner rotation of the adjusting member 62 increases or decreases the force of the tension spring 57 pulling upwardly on the lever 54 and since the lever 54 has an abutment 63, FIG. 2, bearing against the arm 28 of the lever 25, the force of the tension spring 57 is also applied to the right hand end of the arm 28 in the manner illustrated in FIG. 1 to tend to oppose the force of the range spring 41 in moving the lever 25 in a counterclockwise direction in FIG. 1.

However, upward movement of the lever 54 is limited by an adjusting screw 64 threadedly carried by the housing means 11 and having an enlarged end 65 against which the lever 54 will engage when the same has been pulled upwardly by the tension spring 57 a certain amount whereby the lever 54 cannot follow complete counterclockwise pivoting movement of the arm 28 for a purpose hereinafter described.

Figure 3:
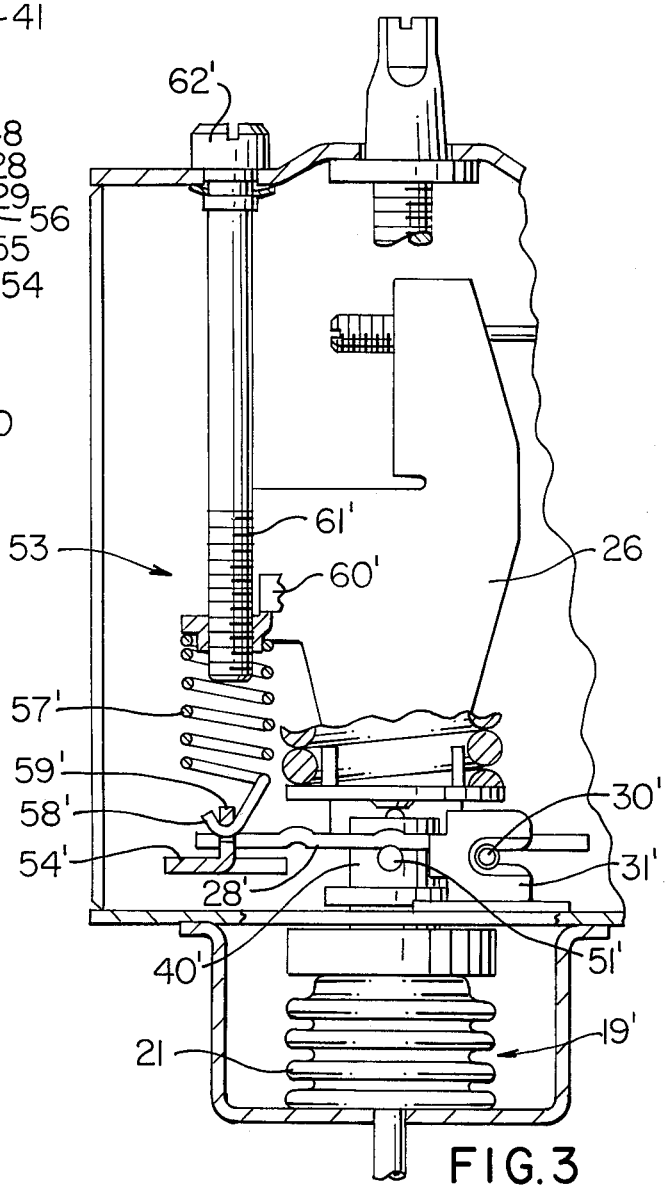
FIG. 3 is a fragmentary view similar to FIG. 1 and illustrates another embodiment of this invention.

Such adjusting means 53 being provided for the arm 26 as illustrated in FIG. 3, has the lever 54' acting on the left hand end of the arm 28' of the lever 26. However, the arm 28' of the lever 26 has its pivot pin 30' disposed to the right of the actuator pin 51' as the bearing means 31' for the pivot pin 30' are disposed to the right of the actuator 40' whereby upward movement of the lever 54' by the tension spring 57' tends to rotate the lever 26 in a clockwise direction rather than in the counterclockwise direction of the lever 25.

If a lower differential is required for the lever 25, a negative force device can be provided therefor. However, in prior known control devices, such negative force imposed force on the bearing point of the lever 25 and thereby increases the hysteresis because of increased friction on the bearing point of the lever.

However, the control device 10 of this invention provides a negative force device that is generally indicated by the reference 66 in FIG. 1 and comprises a swinging or hanging lever 67 having an upper end 68 hanging on a pivot or fulcrum member 69 of the housing means 11 so that a lower free end 70 of the arm 67 is disposed between a pair of spaced abutment means 71 and 72 of a bracket member 73 of the arm 27 for a purpose hereinafter described.

A rolling or C-shaped spring 75 is operatively interconnected to the bracket 69 and to the arm 67 to snap the arm 67 over center so as to provide a force either in a direction to the right in FIG. 1 by having the end 70 engage against the abutment 72 and tend to move the lever 25 in a clockwise direction or have the end 70 move to the left in FIG. 1 and engage against the abutment 71 to tend to move the lever 25 in a counterclockwise direction as will be apparent hereinafter.

In order to increase the fixed differential for the lever 26, a flat leaf spring 74 can have one end 75 fastened to the housing means 11 and another end 76 bearing against the bracket 73 in a direction to tend to move the lever 26 in a counterclockwise direction.

From the above description, it can be seen that the lever arrangement 25 and the lever arrangement 26 are substantially identical and various parts thereof can be utilized interchangeably so that the dual control of this invention can be formed in a simple and effective manner from relatively few parts to operate in a manner now to be described.

Assuming that the condition responsive device 20 is to be utilized as a low pressure cut-in for the switch 12 while the device 19 is to be utilized as a high pressure cut-out for the switch 12, the selector means 45 and 45' are adjusted to respectively set the downward force of the range springs 41 and 41' to the desired settings thereof.

In this manner, should the pressure being sensed by the device 20 be above the low cut-out pressure setting of the selector 45 and be below the high cut-out setting of the selector 45', the levers 25 and 26 are substantially disposed in the positions illustrated in FIGS. 1 and 4 whereby neither lever 17 and 18 of the switch 12 is actuated to the right so that the movable contact 14 is maintained in contact with the fixed contact 15 for any desired purpose.

However, should the pressure being sensed by the device 20 fall below the setting of the selector 45 for the lever 25, the movable wall 24 of the bellows 22 is moving downwardly and the range spring 41 carries the actuator 40 downwardly therewith whereby the pin 51 likewise moves downwardly and causes the arm 28 to pivot in a clockwise direction on the pivot point 30 so that the vertical arm 27 of the lever 25 is moving in a clockwise direction whereby the push rod arrangement 32 will move the lever 18 of the switch 12 to the right until the same actuates the switch blade 13 to move the movable contact 14 out of contact with the contact 15. Such clockwise movement of the lever 25 from the position illustrated in FIG. 1 also causes the arm 67 to move over center and thereby have the spring 35 assist in moving the lever 25 in a clockwise direction once the arm 67 has been moved over center to the right in the drawings. Also, the force of the tension spring 57 retards such clockwise movement of the lever 25 as the arm 28 is moving the lever 54 downwardly.

Conversely, when the pressure in the device 20 begins to increase, the same moves the actuator 40 upwardly and thereby causes the arm 28 to pivot in a counterclockwise direction about the pivot point 30 whereby the lever 25 moves in a counterclockwise direction and permits the push rod assembly 32 to move to the left in FIGS. 1 and 4 until the lever 18 of the switch 12 again places the movable contact 14 into contact with the fixed contact 15 as illustrated in FIG. 4, the spring 75 snapping the arm 67 to the left to assist such counterclockwise movement of the lever 25 and the spring 57 ceasing to help such counterclockwise movement as the lever 54 engages against the stop head 65.

Therefore, it can be seen that the lever 25 and condition responsive means 20 can operate together to operate the switch 12 as a cut-in and cut-out on the low pressure side of a pressure sensing system.

Assuming however that the pressure being sensed by the device 19 continues to increase until the same reaches the setting of the selector knob 45', the expanding bellows 21 is moving the movable wall 23 upwardly and the actuator 40' in opposition to the force of the range spring 41' so that the lever 26 is moving in a clockwise direction and the push rod assembly 32' thereof is being moved to the right in FIGS. 1 and 2 to a position to where the same will subsequently cause the lever 17 of the switch 12 to move the movable contact 14 away from the fixed contact 15 when the high pressure setting of the control device 10 is reached. The switch 12 will not be again closed until that pressure being sensed by the device 19 falls below the high pressure setting of the knob 45' to permit the lever 26 to again move in a counterclockwise direction about the pivot point 30' and thereby permit the push rod assembly 32' to move back to the left and permit the lever 17 of the switch 12 to move to the left and cause the movable contact 14 to be again placed in contact with the fixed contact 15.

Therefore, it can be seen that the control device 10 is a dual control device in that the same will turn off the switch 12 should a sensed pressure fall below a certain low pressure or rise above a certain high pressure with the high and low pressures being respectively selected by the selector knobs 45' and 45 of the control 10.

Of course, a control device can be provided with merely a high pressure cut-out by utilizing the lever arrangement 26 and control device 19 in its own housing or the same can be a low pressure cut-in control by merely utilizing lever 25 and its condition responsive device 20 in its own housing.

Further, the adjustable differential provided by the means 52 and 53 can be utilized or not utilized as the case may be.

For example, when the adjustable differential means 52 is provided, it can be seen that as the pressure increases in the device 20, the counterclockwise moving lever 25 has the arm 28 eventually moved out of the influence of the tension spring 57 as the lever 54 cannot follow complete movement of the lever 25 in a counterclockwise direction as the lever 54 engages against the stop head 65 of the adjusting member 64. Such action is similarly provided by the adjusting means 53 of FIG. 3 for the lever 26.

Therefore, it can be seen that this invention provides an improved condition responsive control device having many novel, useful and unobvious features thereof.

While the form of the invention now preferred has been disclosed and described as required by the Patent Statute, it is to be understood that other forms can be utilized and still fall within the scope of the appended claims.

What is claimed is:

1. In a control device having a housing means carrying a condition responsive means and an electrical switch to be operated by said condition responsive means, said housing means having a pivotally mounted lever to translate motion from a movable wall of said condition responsive means to said switch and having a range spring means to oppose movement of said movable wall in one direction thereof, an actuator disposed between said movable wall of said condition responsive means and said range spring means and being engageable therewith, said actuator being unitary between said movable wall and said range spring means and carrying a pin that is operatively associated with said lever to cause pivoting movement of said lever as said actuator is moved relative to said housing means, said actuator having opposed ends for respectively engaging said range spring means and said movable wall of said condition responsive means, the improvement wherein said range spring means has misalignment compensating means engaging its respective end of said actuator.

2. In a control device as set forth in claim 1, said actuator having a side opening therein intermediate said ends thereof, said pin being disposed in said opening and extending out of the same.

3. In a control device as set forth in claim 2, said pin fitting closely in said opening.

4. In a control device as set forth in claim 3, said pin and said opening being cylindrical.

5. In a control device as set forth in claim 1, said misalignment compensating means of said range spring means including a ball member engaging said respective end of said actuator.

6. In a control device as set forth in claim 5, said misalignment compensating means of said range spring means including a spring retainer carrying said ball member.

7. In a control device having a housing means carrying a condition responsive means and an electrical switch to be operated by said condition responsive means, said housing means having a pivotally mounted lever to translate motion from a movable wall of said condition responsive means to said switch and having a range spring means to oppose movement of said movable wall in one direction thereof, an actuator disposed between said movable wall of said condition responsive means and said range spring means and being engageable therewith, said actuator being unitary between said movable wall and said range spring means and carrying a pin that is operatively associated with said lever to cause pivoting movement of said lever as said actuator is moved relative to said housing means, the improvement wherein said lever is substantially L-shaped and thereby defines two arms joined together at an elbow thereof, one of said arms being operatively associated with said pin and said lever being pivotally mounted to said housing means by said one arm at a point remote from said pin.

8. In a control device having a housing means carrying a condition responsive means and an electrical switch to be operated by said condition responsive means, said housing means having a pivotally mounted lever to translate motion from a movable wall of said condition responsive means to said switch and having a range spring means to oppose movement of said movable wall in one direction thereof, the improvement comprising a movable push rod arrangement movably carried by said housing means and being operatively associated with said lever and said switch to translate motion between said lever and said switch, said switch having a pivot movement different than the pivot movement of said lever, said push rod arrangement having pivot bearing means thereon to compensate for said different pivot movements of said lever and said switch.

9. In a control device as set forth in claim 8, said lever carrying a socket member that forms part of said pivot bearing means, said push rod arrangement comprising a rod having opposed ends, one of said ends of said rod being received in said socket member to form part of said pivot bearing means.

10. In a control device as set forth in claim 9, said socket member being adjustable relative to said lever.

11. In a control device as set forth in claim 11, said socket member being threadedly mounted to said lever so as to be adjustable relative thereto.

12. In a control device as set forth in claim 9, the other of said ends of said rod also being rounded to provide part of said pivot bearing means adjacent said switch.

13. In a control device having a housing means carrying a condition responsive means and an electrical switch to be operated by said condition responsive means, said housing means having a pivotally mounted lever to translate motion from a movable wall of said condition responsive means to said switch and having a range spring means to oppose movement of said movable wall in one direction thereof, said housing means carrying adjustable differential means operatively associated with said lever to provide for an adjustable differential of said control device, said housing means carrying snap action biasing means that is operatively associated with said lever to lower said differential of said control device without imposing force to the pivot point of said lever, said biasing means providing lost motion with said lever before the same moves over center, said biasing means comprising a pivotally mounted arm having a free end, said lever having a pair of spaced apart abutment means receiving said free end of said arm therebetween, the improvement wherein said biasing means comprises a C-shaped spring for rendering said arm snap acting.

14. In a control device as set forth in claim 13, said arm hanging from said housing means to provide a pivot and swinging mounting therewith and said free end of said arm being a depending end of said hanging arm.

* * * * *